US010265704B2

(12) United States Patent
Bauer

(10) Patent No.: US 10,265,704 B2
(45) Date of Patent: Apr. 23, 2019

(54) SOLID BOWL CENTRIFUGE WITH AN OUTLET DEVICE HAVING A DEFLECTING SEGMENT TO DEFLECT FLUID TOWARD A CIRCUMFERENCE OF THE END WALL AND A GUIDE DOWNSTREAM OF THE DEFLECTING SEGMENT

(71) Applicant: Flottweg SE, Vilsbiburg (DE)

(72) Inventor: Georg Bauer, Geisenhausen (DE)

(73) Assignee: Flottweg SE, Vilsbiburg (DE)

( * ) Notice: Subject to any disclaimer, the term of this patent is extended or adjusted under 35 U.S.C. 154(b) by 780 days.

(21) Appl. No.: 14/644,429

(22) Filed: Mar. 11, 2015

(65) Prior Publication Data

US 2015/0273482 A1 Oct. 1, 2015

(30) Foreign Application Priority Data

Mar. 27, 2014 (DE) ..... 10 2014 104 296

(51) Int. Cl.

*B04B 1/20* (2006.01)
*B04B 11/02* (2006.01)
*B04B 7/08* (2006.01)

(52) U.S. Cl.

CPC ..... *B04B 7/08* (2013.01); *B04B 1/20* (2013.01); *B04B 11/02* (2013.01); *B04B 2001/2075* (2013.01); *B04B 2001/2083* (2013.01)

(58) Field of Classification Search

CPC ..... B04B 1/20; B04B 11/00; B04B 11/02; B04B 2001/2083; B04B 2001/2075; B04B 7/08

USPC ..... 494/53, 54, 56, 57; 210/380.1, 380.3

See application file for complete search history.

(56) References Cited

U.S. PATENT DOCUMENTS

| | | | | |
|---|---|---|---|---|
| 4,335,846 | A | 6/1982 | Shapiro | |
| 7,022,061 | B2 * | 4/2006 | Leung | B04B 1/20 494/56 |
| 9,908,125 | B2 * | 3/2018 | Geehan | B04B 11/06 |
| 9,993,831 | B2 * | 6/2018 | Pasol | B04B 1/20 |
| 10,105,715 | B2 * | 10/2018 | Schlarb | B04B 1/20 |
| 10,105,716 | B2 * | 10/2018 | Vielhuber | B04B 1/20 |

(Continued)

FOREIGN PATENT DOCUMENTS

| | | | |
|---|---|---|---|
| DE | 20 2011 110 235 | 4/2013 | |
| EP | 2923769 A1 * | 9/2015 | B04B 1/20 |

(Continued)

*Primary Examiner* — Charles Cooley

(74) *Attorney, Agent, or Firm* — Gerald E. Hespos; Michael J. Porco; Matthew T. Hespos

(57) ABSTRACT

An outlet device of a solid bowl centrifuge for separating a multi-phase material is arranged on an end wall of a centrifuge bowl that rotates about a longitudinal axis. An outlet opening is formed in the end wall and has a deflecting apparatus configured so that a fluid of the material that has passed through the outlet opening is deflected toward the circumference of the end-wall. The deflecting apparatus has a segment spaced from the longitudinal axis by a segment radius and has a deflecting segment, along which the deflected fluid can be conducted toward the circumference of the end-wall before being thrown off laterally by the outlet device. The outlet device has a guide that brings the deflected fluid to a lower-energy positional potential in the gravitation field of the solid bowl centrifuge before being thrown off by the outlet device.

14 Claims, 3 Drawing Sheets

(56) References Cited

U.S. PATENT DOCUMENTS

| | | | | |
|---|---|---|---|---|
| 2004/0072667 | A1* | 4/2004 | Leung | B04B 1/20 494/56 |
| 2004/0072668 | A1* | 4/2004 | Leung | B04B 1/20 494/56 |
| 2014/0235423 | A1* | 8/2014 | Pasol | B04B 1/20 494/56 |
| 2015/0165449 | A1* | 6/2015 | Horstkoetter | B04B 1/20 494/53 |
| 2015/0217303 | A1* | 8/2015 | Bauer | B04B 1/2016 494/4 |
| 2015/0273482 | A1* | 10/2015 | Bauer | B04B 1/20 494/43 |

FOREIGN PATENT DOCUMENTS

| | | | | |
|---|---|---|---|---|
| JP | 11179236 | A * | 7/1999 | |
| JP | 11197547 | A * | 7/1999 | |
| JP | 11197548 | A * | 7/1999 | |
| WO | WO 2013017223 | A1 * | 2/2013 | B04B 1/20 |

* cited by examiner

SOLID BOWL CENTRIFUGE WITH AN OUTLET DEVICE HAVING A DEFLECTING SEGMENT TO DEFLECT FLUID TOWARD A CIRCUMFERENCE OF THE END WALL AND A GUIDE DOWNSTREAM OF THE DEFLECTING SEGMENT

BACKGROUND

1. Field of the Invention

The invention relates to an outlet device of a solid bowl centrifuge for separating a multi-phase material. The outlet device is arranged on an end wall of a centrifuge bowl that rotates about a longitudinal axis, at an outlet opening formed in the end wall, and comprises a deflecting apparatus for deflecting in the direction of the end-wall circumference the material that has passed through the outlet opening. The deflecting apparatus has a segment element, which is spaced from the longitudinal axis by a segment radius and along which the deflected material can be conducted in the direction of the end-wall circumference before being laterally thrown off by the outlet device.

2. Description of the Related Art

In general, solid bowl centrifuges are characterized by a rotatable centrifuge bowl that has a largely closed bowl wall having a usually horizontally extending axis of rotation or longitudinal axis. The centrifuge bowl is rotated by means of a drive having a high rotational velocity. A multi-phase material to be centrifuged is introduced into the centrifuge bowl by means of a usually centrally arranged inlet pipe. The multi-phase material is then subjected to a high centrifugal force by means of the rotation of the centrifuge bowl, whereby the multi-phase material is caused to lie against the inside of the bowl wall as a pond. A phase separation occurs in the material centrifuged in such a way, wherein comparatively light material in the pond migrates radially inward as a light phase and comparatively heavy material migrates radially outward as a heavy phase. The light phase can be discharged as a fluid radially inside by means of an outlet device, while the heavy phase is discharged from the centrifuge bowl by means of a screw conveyor.

For example, a liquid-phase outlet connection component arranged on a bowl of a decanter centrifuge and having a straight channel is known from DE 20 2011 110 235 U1. This channel forms a segment, which is spaced from a longitudinal axis of the decanter centrifuge by a segment radius. The channel is arranged at an acute angle in relation to an end-face bowl baseplate in order to deflect a material, which has passed through an outlet opening in the baseplate, laterally with respect to the bowl. The material escaping from the outlet opening substantially in an axial direction can thereby be deflected laterally outward along the segment element in order to recover energy before the material is thrown off at the end of the straight channel or of the segment at the height of the segment radius by the liquid-phase outlet connection component.

The problem addressed by the invention is that of further developing generic outlet devices of a solid bowl centrifuge in order to achieve more effective energy recovery.

SUMMARY OF THE INVENTION

The invention relates to an outlet device of a solid bowl centrifuge for separating a multi-phase material. The outlet device is arranged on an end wall of a centrifuge bowl that rotates about a longitudinal axis, at an outlet opening formed in the end wall, and comprises a deflecting apparatus for deflecting in the direction of the end-wall circumference a fluid of the material that has passed through the outlet opening, the deflecting apparatus having a segment element, which is spaced from the longitudinal axis by a segment radius and which has a deflecting segment, along which the deflected fluid can be conducted in the direction of the end-wall circumference before being laterally thrown off by the outlet device, wherein according to the invention the outlet device comprises guiding means, by means of which the deflected fluid can be brought to a lower-energy positional potential in the gravitational field of the solid bowl centrifuge before being thrown off by the outlet device.

Thus, according to the invention, the outlet device comprises guiding means, by means of which the deflected fluid can be brought to a lower-energy positional potential in the gravitational field of the solid bowl centrifuge before being thrown off by the outlet device. The deflected fluid can thereby be additionally accelerated on the outlet device before being finally thrown off by the outlet device, whereby in turn the recoil effect on the outlet device is increased and thus in particular the energy savings for the driving of the centrifuge bowl can be improved.

The effect of the outlet devices known to date is generally based on deflecting the fluid of the material located in the centrifuge bowl that has passed through the outlet opening only once in the direction of the end-wall circumference. In this case, the flow velocity of the fluid conducted and thrown off in the direction of the end-wall circumference depends largely on the rate of fluid flow through the outlet opening, because up to now a deliberate, additionally desired acceleration of the fluid did not occur.

However, according to the present invention, because of the additional guiding means, the fluid can be deflected at least twice on its way to a throw-off edge in such a way that the effect of an additional acceleration can thereby be achieved. A first time, the fluid is deflected at the outlet opening or shortly thereafter in order to deflect in the direction of the end-wall circumference the fluid pushing out of the centrifuge bowl substantially in the axial direction. A second time, the fluid that has already been deflected in such a way and conducted further in the direction of the end-wall circumference on the outlet device experiences an additional direction change in a radial direction of the centrifuge bowl, wherein the fluid is accelerated by centrifugal forces acting on the fluid before the fluid is finally thrown off by the outlet device. This additional direction change occurs parallel or askew to the end wall.

The invention relates to a method for recovering energy at a solid bowl centrifuge for separating a multi-phase material located in a centrifuge bowl that rotates about a longitudinal axis, in which method a phase of the material in the form of a fluid passes in the direction of the longitudinal axis through an outlet opening formed in the end wall of the centrifuge bowl, the fluid that has passed through the outlet opening is deflected in the direction of the end-wall circumference by means of a deflecting apparatus, and the fluid deflected in the direction of the end-wall circumference is conducted along a deflecting segment formed by the deflecting apparatus before the fluid is thrown off laterally after leaving the deflecting segment of the deflecting device, the method being characterized in that the fluid conducted along the deflecting segment is brought to a lower-energy positional potential in the gravitational field of the solid bowl centrifuge after leaving the deflecting segment, before being finally laterally thrown off by the outlet device. Thus, after the fluid has left the deflecting segment, the fluid is accelerated again radially to the longitudinal axis instead of being thrown off, before the fluid is then thrown off by the outlet device.

The additional acceleration effect is achieved mainly by purposefully leading the fluid away on a fluid-conducting contour of the guiding means that faces radially outside, which guiding means extend between the deflecting segment and the throw-off edge. In this process, the fluid is purposefully guided to a larger radius. If a mass is brought to a larger radius in the gravitational field of the solid bowl centrifuge, this means that the mass is brought to a lower level of potential energy in relation to the centrifugal field without consideration of the circumferential velocity associated therewith.

The difference in potential energy can be converted into kinetic energy in accordance with the invention, as is the case here.

For this purpose, the guiding means are arranged downstream of the actual deflecting segment.

Specifically, the guiding means are preferably arranged downstream of the actual deflecting segment in such a way that the already deflected fluid is additionally accelerated on the way to the end-wall circumference by means of another guided direction change in the radially outside direction.

Of course, particularly the segment element and the guiding means can be realized in a variety of ways. In an especially structurally simple manner, the segment element and the guiding means can be integrated into the outlet device if the segment element and the guiding means are produced as a one-piece component, which at least partially composes the deflecting apparatus.

In an especially advantageous development of the invention, the guiding means are designed in such a way that the material conducted along the deflecting segment can be guided from the segment radius to a throw-off radius lying radially further outside before the material is thrown off by the outlet device. The segment radius and the throw-off radius preferably satisfy the equation:

$$R=r\cdot((a/100)\cdot n+1)$$

wherein R=throw-off radius, r=segment radius, n=number of outlet holes on the associated circumference of the end wall, a=preference factor. The preference factor is selected preferably between 1 and 6, more preferably between 2 and 5, especially preferably between 3 and 4.

In this context, it is advantageous if the guiding means are arranged radially behind the segment element in such a way that the material conducted along the segment can be guided from the segment radius defined by the segment element to a throw-off radius lying radially further outside before the material is thrown off by the outlet device.

Furthermore, it is advantageous if the guiding means comprise an acceleration segment, along which the fluid can be accelerated between the segment radius and a throw-off radius of the outlet device. Thus, the rotation of the centrifuge bowl can be supported more greatly.

While the deflecting segment primarily serves only the purpose of deflecting the fluid in the circumferential direction, the present acceleration segment primarily serves to accelerate the already deflected fluid again.

The acceleration segment is arranged downstream of the actual deflecting segment in such a way that the already deflected fluid is additionally accelerated on the way to the end-wall outer circumference by means of another direction change.

The deflecting apparatus preferably is designed in such a way that a direction of the course of the outer contour of the deflecting apparatus changes in a transition region, in which the deflecting segment transitions into the acceleration segment.

If the guiding means have a throw-off edge, which is arranged on the end face and is spaced from the longitudinal axis by a throw-off radius, wherein the throw-off radius is larger than the segment radius, the material can be further accelerated in the direction of the end-wall circumference before the material is thrown off by the outlet device. Thus, in particular a throw-off edge for the deflected and then accelerated material can be provided in a structurally simple manner, which throw-off edge is arranged radially further outside than the deflecting segment of the segment element.

If the guiding means comprise a curved guiding element, which extends from radially further inside to radially further outside, the material conducted in the direction of the end-wall circumference can be guided radially further outside in an especially operationally reliable manner before the material is thrown off by the outlet device. By means of the curved guiding element, the accelerated material experiences another direction change so that the material can then be thrown off by the outlet device more advantageously.

An especially good acceleration path can be created by means of the guiding means if the guiding means comprise a concave guiding surface that faces the longitudinal axis. Said guiding surface is formed concave in the radial direction. Cumulatively, the guiding surface can also be formed concave in the axial direction so that the guiding surface can guide the fluid better.

In a variant of a preferred embodiment, the outlet opening is arranged on a hole circle having a hole circle radius, wherein a throw-off radius of the outlet device is larger than the hole circle radius. Thus, a throw-off edge can be arranged further radially outside, whereby the energy recovery is further improved.

In a particularly advantageous embodiment variant, the outlet device comprises a dam element spaced from the longitudinal axis by a dam radius, wherein a throw-off radius of the outlet device is larger than the dam radius.

In this respect, the dam element is arranged radially further inside than the throw-off edge of the outlet device, so that the already deflected material can be further accelerated in accordance with the invention.

The dam element can be created in an especially structurally simple manner if the dam element is realized directly by a contour of the deflecting apparatus.

It can be advantageous if the dam element is arranged between the deflecting segment of the segment element and the acceleration segment of the guiding means.

The segment element, the curved guiding element, and the dam element are preferably integrated as a single part of the deflecting apparatus so that the outlet device has a very compact construction.

Furthermore, it is advantageous if the outlet device has a throw-off angle $\alpha>0°$ in relation to a tangent that is tangent to a throw-off radius of the outlet device. The tangent is preferably tangent to the throw-off radius at a point of intersection produced by the throw-off radius and the throw-off edge.

With regard to energy, a throw-off angle of 0° in relation to said tangent, i.e., a tangential throw-off in the direction of the tangent to the throw-off radius, is admittedly most effective. However, in this case there is a risk that jets of the fluids thrown off by two outlet devices arranged directly one after the other on the hole circle will collide with each other. In this respect, it is advantageous to select a throw-off angle $\alpha>0°$.

If the throw-off angle α has a value between 1° and 30°, collisions between the fluid thrown off by the outlet device and another fluid thrown off by another outlet device arranged on the end wall can be reliably prevented.

If the throw-off angle α has an alternative value between 3° and 20°, the fluid thrown off by the outlet device can be thrown off radially outward with even greater operational reliability.

The fluid can be thrown off by the outlet device even more effectively and reliably in accordance with the invention if the throw-off angle α has a value between 5° and 15°.

Below, two embodiments of outlet devices according to the invention on a solid bowl centrifuge are explained in more detail on the basis of the enclosed schematic drawings.

DETAILED DESCRIPTION OF THE PREFERRED EMBODIMENTS

Figure 1:
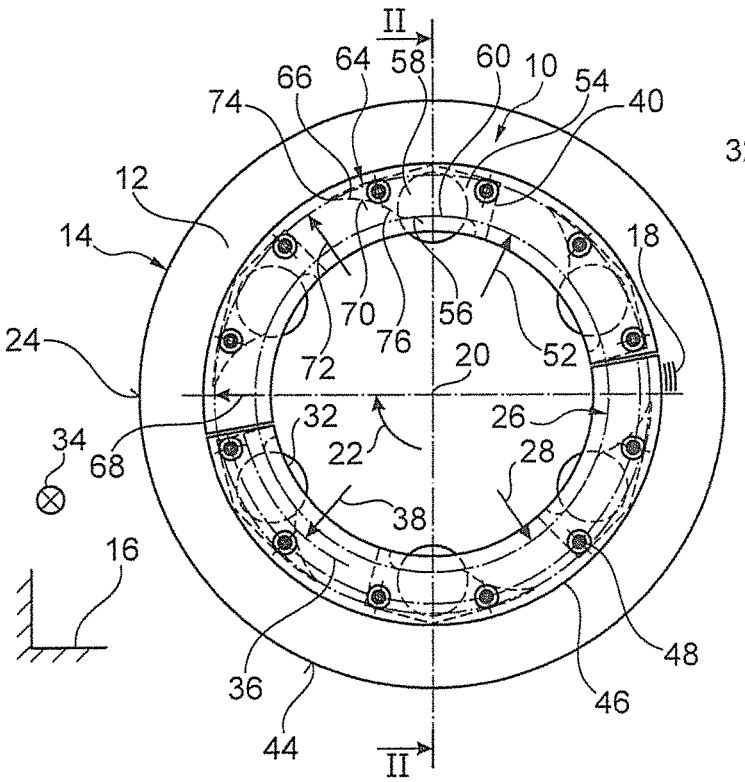
FIG. 1 is a frontal view of an end wall of a centrifuge bowl of a solid bowl centrifuge, wherein six outlet devices according to a first embodiment are arranged on the end wall.
Figure 2:
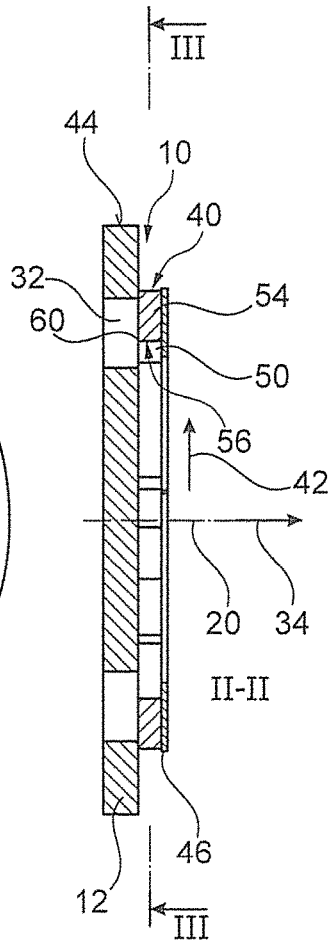
FIG. 2 is section II-II in FIG. 1.
Figure 3:
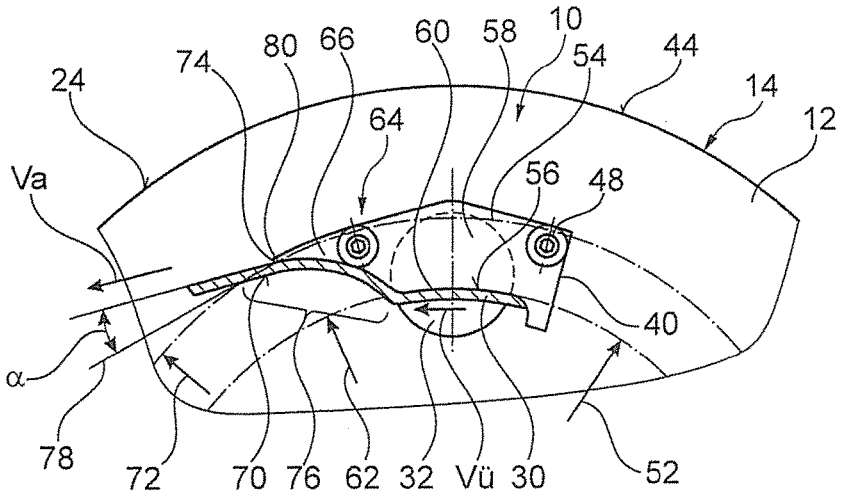
FIG. 3 is section III-III in FIG. 2 at a magnified scale.

In the first embodiment, which is shown in FIGS. 1 to 3, a plurality of first outlet devices 10 (numbered only as an example) is fastened to an end wall 12 of a centrifuge bowl 14 of a solid bowl centrifuge 16 for separating a multi-phase material 18. The end wall 12 forms an axial centrifuge bowl cover. A centrifuge screw conveyor, which is not shown, is located within said solid bowl centrifuge 16. The centrifuge bowl 14 rotates about a longitudinal axis 20 in a driven state, which longitudinal axis is also the center axis and the axis of rotation of the centrifuge bowl 14. The multi-phase material 18 in itself forms a pond or liquid ring 26 on the inside of the bowl body 24 of the centrifuge bowl 14 when there is adequately fast rotation of the centrifuge bowl 14 in a direction of rotation 22. The pond has a liquid level or pond radius 28, which substantially depends on the throughput in the centrifuge bowl 14 of material 18 to be clarified. If much material 18 to be clarified is fed into the centrifuge bowl 14 per unit of time but only little clarified material in the form of fluid 30 (see FIG. 3) is discharged per unit of time, the liquid level rises and the associated pond radius 28 decreases. If relatively more fluid 30 is discharged, said liquid level falls. Of course, the liquid level also depends on the amount of material 18 of the heavy phase discharged from the centrifuge bowl 14 per unit of time, but this should not be discussed further here.

Six circular outlet openings 32 are formed in the end wall 12 to accommodate a discharge of the fluid 30 in an axial direction 34 of the longitudinal axis 20, if there is a corresponding liquid level within the centrifuge bowl 14. Thus, the circular outlet openings 32 serve to discharge or to let out clarified material of a lighter phase in the form of the fluid 30 from the centrifuge bowl 14. The circular outlet openings 32 are arranged on the end wall 12 concentrically about the longitudinal axis 20 at a uniform distance on a hole circle 36 having a hole circle radius 38. To be able to discharge the fluid 30 flowing through the circular outlet openings 32 in a controlled manner, one of the outlet devices 10 is attached to the end wall 12 in front of each circular outlet opening 32.

Each of the six outlet devices 10 comprises a deflecting apparatus 40 (numbered here only as an example) for deflecting the fluid 30 that has passed substantially axially through the outlet opening 32, so that said fluid 30 is deflected laterally in the direction 42 of the end-wall circumference 44 and is conducted radially outward in relation to the longitudinal axis 20, before said fluid 30 is thrown off by the particular outlet device 10, in order to achieve energy recovery. The six deflecting apparatuses 40 are fastened to the end wall 12 by means of a common retaining ring 46, wherein each of the deflecting apparatuses 40 is firmly screwed onto the end wall 12 by means of two screws 48 (numbered only as an example), which are each inserted through the common retaining ring 46.

In addition, the common retaining ring 46 ensures that the fluid 30 to be deflected can flow away only laterally in the direction 42 of the end-wall circumference 44 and not further in the axial direction 34. In this respect, the common retaining ring 46 forms, at each of the outlet devices 10, an axial baffle plate element (not numbered here) of the respective deflecting apparatus 40 in such a way that a corresponding bowl-shaped conducting space 50 for accommodating the fluid 30 to be deflected is created at the respective deflecting apparatus 40 between the end wall 12 and the common retaining ring 46.

To conduct the deflected fluid 30 radially outward, the deflecting apparatus 40 also comprises a segment element 54 spaced from the longitudinal axis 20 by a segment radius 52, which segment element 54 defines a deflecting segment 56, wherein the segment radius 52 refers to the distance between the deflecting segment 56 and the longitudinal axis 20.

In this embodiment, because of a corresponding design of the segment element 54, the deflecting apparatus 40 directly embodies a dam element 58, a dam edge 60 of which defines a dam radius 62. In this respect, the dam radius 62 is defined by the geometry of the segment element 54 at the same time. The fluid 30 flowing axially through the outlet opening 32 enters the bowl-shaped conducting space 50 over said dam edge 60, from which conducting space 50 the fluid 30 is deflected and conducted in the direction 42 of the end-wall circumference 44.

According to the invention, to further accelerate the fluid 30 conducted along the deflecting segment 56 before the fluid 30 is thrown off by the outlet device 10 and to thereby make the energy recovery more effective, each of the outlet devices 10 comprises guiding means 64, by means of which the deflected fluid 30 can be brought to a lower-energy positional potential in the gravitational field of the solid bowl centrifuge 16 before being thrown off by the outlet device 10. Such guiding means 64 can be realized in a variety of ways.

In the present embodiments, the guiding means 64 are embodied by a curved guiding element 66 in a structurally simple manner, which extends from radially further inside to radially further outside in accordance with arrow direction 68. The curved guiding element 66 is curved in such a way that a guiding surface 70 formed thereby is concave. Said concave guiding surface 70 is integrated in the respective outlet device 10 in such a way that said concave guiding surface 70 faces the longitudinal axis 20. Thus, a fluid 30 pushing outward because of the centrifugal forces can be guided especially advantageously.

In particular, the curved guiding element 66 is designed in such a way that the fluid 30 conducted along the deflecting segment 56 can be guided from the segment radius 52 defined by the segment element 54 to a throw-off radius 72 lying radially further outside before the fluid 30 is thrown off by a throw-off edge 74 of the respective outlet device 10. The segment radius 52 and thus also the deflecting segment 56 are therefore arranged radially further inside than the throw-off edge 74.

The curved guiding element 66 forms an acceleration segment 76 (see in particular FIG. 3), by means of which the fluid 30 is accelerated between the deflecting segment 56 and the throw-off radius 72. As viewed in the direction of the end-wall circumference 44, said acceleration segment 76 is arranged after the deflecting segment 56 of the segment element 54 in such a way that the fluid 30 conducted along the deflecting segment 56 experiences a direction change in the direction of rotation 22 of the centrifuge bowl 14 during the transition between the deflecting segment 56 and the acceleration segment 76. Therefore, the fluid 30 can be better accelerated by centrifugal forces that act on the fluid 30 because of the rotation of the centrifuge bowl 14.

Advantageously, the deflected fluid 30 is deflected at least once more by means of the acceleration segment 76, namely radially outwardly and in a direction opposite the direction of rotation 22, before the fluid 30 is thrown off by the outlet device 10. For this purpose, the guiding element 66 is curved, as already described above. By means of the deflection of the fluid 30 radially outwardly and in the opposite direction, the fluid 30 is pressed against the curved guiding surface 70, so that it can be ensured that the fluid 30 is thrown off by the outlet device 10 only at the throw-off edge 74.

The throw-off of the fluid 30 accelerated again is achieved especially advantageously at a throw-off angle $\alpha$ in a throw-off range between 5° and 15°, which here is provided at each of the outlet devices 10. The throw-off angle $\alpha$ is related here to a tangent 78 that is tangential to the throw-off radius 72 at a point of intersection 80 of the throw-off radius 72 and the throw-off edge 74. The throw-off range also depends on the rotational speed of the centrifuge bowl 14.

In particular in the illustration of FIG. 3, it can be clearly seen that the fluid 30 has the velocity vu at the height of the dam radius 62 after the deflection of the fluid 30 in the direction 42 of the end-wall circumference 44. Because the fluid 30 is conducted to the larger throw-off radius 72, the fluid 30 is at a level having a lower potential energy in the gravitational field of the solid bowl centrifuge 16 there. The higher potential energy still inherent in the fluid 30 at the height of the dam radius 62 or at the height of the segment radius 52 was converted into kinetic energy along the acceleration segment 76 of the guiding means 64, so that the fluid 30 is thrown off by the particular outlet device 10 at the throw-off radius 72 at the throw-off velocity va>vü. The fluid 30, while being conducted along the curved guiding element 66, is guided from the dam radius 62 lying further inside or the segment radius 52 to the throw-off radius 72 lying further outside.

Figure 4:
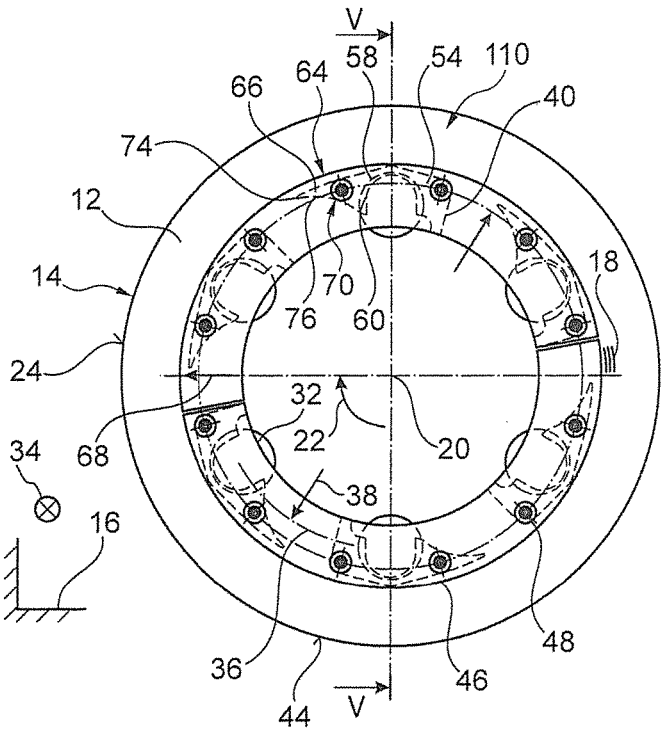
FIG. 4 is a frontal view according to FIG. 1, wherein outlet devices according to a second embodiment are arranged on the end wall.
Figure 5:
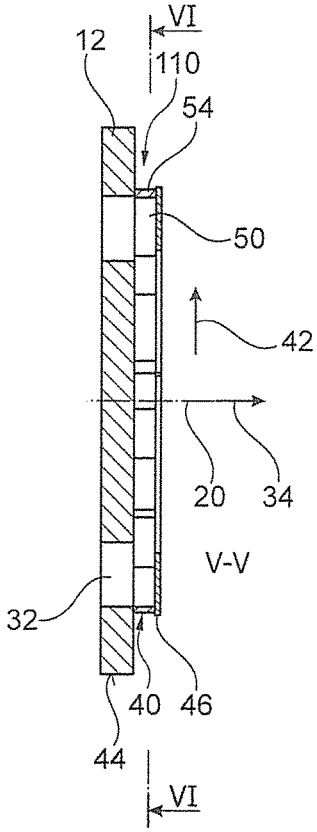
FIG. 5 is section V-V in FIG. 4.
Figure 6:
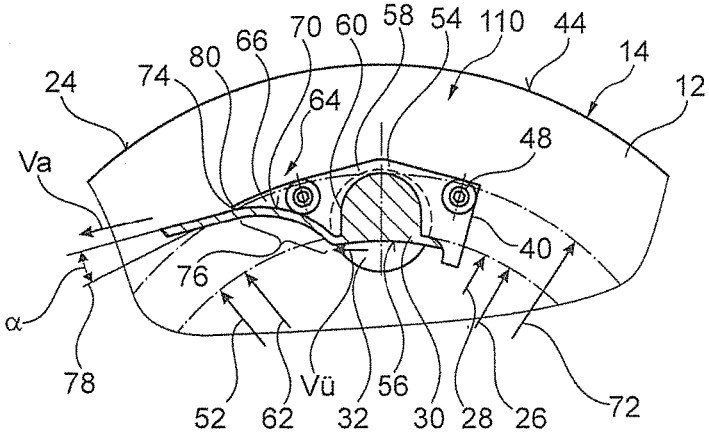
FIG. 6 is section VI/VI in FIG. 5 at a magnified scale.

In the second embodiment, which is shown in FIGS. 4 to 6, alternative outlet devices are installed on the end wall 12 described above. In this respect, components of the two embodiments that correspond at least substantially with regard to their function are marked with the same reference signs here, wherein the components do not have to be numbered in all figures and explained. With regard to the second embodiment, reference is made to the explanations of the first embodiment above in order to also avoid repetitions.

As can be readily seen in the illustrations of FIGS. 4 to 6, in which the alternative outlet devices 110 are shown, it can be more favorable alternatively to perform the deflection of the fluid 30 even before the actual dam edge 60 instead of deflecting the fluid 30 at or after the dam radius 62. Thus, the deflection of the fluid 30 occurs already at a low flow velocity vf, whereby a deflection of the fluid 30 can be achieved with lower losses caused by turbulence. When the fluid 30 flows over the dam edge 60, the fluid 30 is then increased to the velocity vu. By the conduction of the fluid 30 to the throw-off radius 72 lying radially further outside, the throw-off velocity va is reached, similarly to the embodiment shown in FIGS. 1 to 3 and the description above regarding said embodiment.

The two embodiments are substantially structurally identical, except for the differently designed dam edge 60 and the segment element 54 of the alternative outlet device 110.

Further advantages with regard to the two outlet devices 10 and 110 can be achieved if the dam radius 62 can be variably set, for example by means of a radially movable design of the dam element 58, such as by means of eccentric disks (not shown here).

Furthermore, in order to make the mounting of the outlet devices 10 or 110 on the end wall 12 simpler, the respective deflecting apparatus or the related segment element 54 and/or the guiding means 64, and the common retaining ring 46 can be rigidly connected to each other before the mounting of the particular outlet device 10 or 110.

Depending on the preferred embodiment, the effective dam edge 60 can lie in a plane parallel to the end wall 12 (see first embodiment, FIGS. 1 to 3), in a plane arranged perpendicularly to the end wall 12 (see second embodiment, FIGS. 4 to 6), or set at an angle between 0° and 90°.

Figure 7:
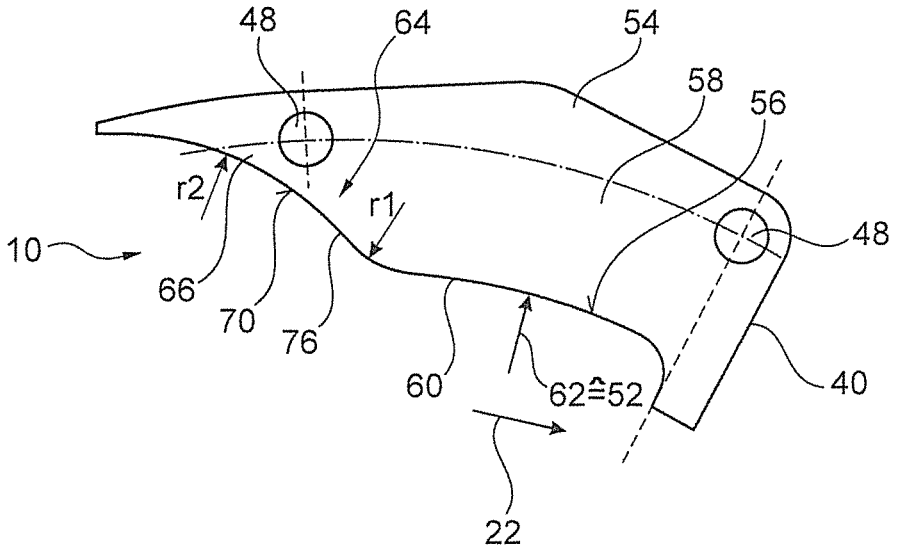
FIG. 7 is section III-III of an outlet device according to FIG. 1 at a further magnified scale.

From the outlet device 10 illustrated in FIG. 7, it can be seen how the outlet device 10 is preferably designed in detail. The outlet device 10 is designed with the deflecting apparatus 40 and the plate-shaped dam element 58, which is attached to the associated end wall 12 of the centrifuge bowl 14 in a stationary manner, with the screws 48 in boreholes of the dam element 58, or movably, with the screws 48 in elongated holes of the dam element 58. The centrifuge bowl 14 rotates in the direction rotation 22. Over the deflecting segment 56 of the segment element 54, the dam edge 60 is formed by the dam element 58. The dam edge 60 defines the dam radius 62. Here, the dam radius 62 corresponds to the segment radius 52, wherein the segment radius 52 can advantageously also be slightly larger than the dam radius 62, so that the clarified material or fluid flows over the dam edge 60 in the form of a small hurdle or a hill. The guiding means 64, which has the curved guiding element 66, adjoins the segment element 54 against the direction of rotation 22. The curved guiding element 66 has a convex segment at the transition to the deflecting segment 56, which convex segment is formed with a radius r1. The guiding surface 70, which is designed as a concave segment having a radius r2, adjoins the convex segment. The two radii r1 and r2 have a ratio r1:r2 preferably of 1:1.5 to 1:10, more preferably of 1:2 to 1:6, especially preferably of 1:2.5 to 1:3.5.

Finally, it is noted that all features stated in the application documents and in particular in the dependent claims, despite the formal reference made to one or more certain claims, should also be given independent protection individually or in any combination.

LIST OF REFERENCE SIGNS

10 outlet device
12 end wall
14 centrifuge bowl
16 solid bowl centrifuge
18 multi-phase material
20 longitudinal axis
22 direction of rotation
24 bowl wall
26 liquid ring
28 pond radius or liquid level
30 fluid
32 outlet opening
34 axial direction
36 hole circle
38 hole circle radius
40 deflecting apparatus
42 direction
44 end-wall circumference
46 retaining ring
48 screws
50 conducting space
52 segment radius
54 segment element
56 deflecting segment
58 dam element
60 dam edge
62 dam radius
64 guiding means
66 curved guiding element
68 arrow direction
70 guiding surface
72 throw-off radius
74 throw-off edge
76 acceleration segment
78 tangent
80 point of intersection
110 alternative outlet device
r1 radius
r2 radius

What is claimed is:

1. An outlet device (10; 110) of a solid bowl centrifuge (16) for separating a multi-phase material (18), the outlet device (10; 110) being arranged on an end wall (12) of a centrifuge bowl (14) that rotates in a rotational direction about a longitudinal axis (20), an outlet opening (32) being formed in the end wall (12), the outlet device (10, 110) comprising: a deflecting apparatus (40) configured so that a fluid (30) of the material (18) that has passed through the outlet opening (32) is deflected by the deflecting apparatus (40) in a direction (42) of a circumference (44) of the end wall (12), the deflecting apparatus (40) having a segment element (54) that is spaced from the longitudinal axis (20) by a segment radius (52), the segment element (54) including a deflecting segment (56) along which the deflected fluid (30) can be conducted toward the circumference (44) of the end wall (12) before being laterally thrown off by the outlet device (10; 110), wherein:

the outlet device (10; 110) further comprises a guide (64) arranged downstream of the segment element (54) with respect to the rotational direction and configured to bring the deflected fluid (30) to a lower-energy positional potential in a gravitational field of the solid bowl centrifuge (16) before being thrown off by the outlet device (10; 110); and the outlet device (10; 110) comprises a dam element (58) that is spaced from the longitudinal axis (20) by a dam radius (62) that is measured from the longitudinal axis, wherein a throw-off radius (72) of the outlet device (10; 110) measured from the longitudinal axis is larger than the dam radius (62).

2. The outlet device (10; 110) of claim 1, wherein the guide (64) is configured so that the fluid (30) conducted along the deflecting segment (56) can be guided from the segment radius (52) to the throw-off radius (72) that is measured from the longitudinal axis and that is radially farther out from the longitudinal axis than the segment radius (52), the guide (64) being at a position so that the fluid (30) reaches the guide (64) before the fluid (30) is thrown off by the outlet device (10; 110).

3. The outlet device (10; 110) of claim 1, wherein the guide (64) comprises an acceleration segment (76), along which the fluid (30) can be accelerated between the segment radius (52) and the throw-off radius (72) of the outlet device (10; 110), the throw-off radius (72) being measured from the longitudinal axis and being radially farther out from the longitudinal axis than the segment radius (52), the guide (64) being at a position so that the fluid (30) reaches the acceleration segment (76) before the fluid (30) is thrown off by the outlet device (10; 110).

4. The outlet device (10; 110) of claim 1, wherein the guide (64) has a throw-off edge (74) that is arranged on the end wall (12) in such a way that the throw-off edge (74) is spaced from the longitudinal axis (20) by the throw-off radius (72) that is measured from the longitudinal axis, the throw-off radius (72) being larger than the segment radius (52).

5. The outlet device (10; 110) of claim 1, wherein the guide (64) comprises a curved guiding element (66) that extends from radially farther inside to radially farther outside.

6. The outlet device (10; 110) of claim 1, wherein the guide (64) comprises a concave guiding surface (70) that faces the longitudinal axis (20).

7. The outlet device (10; 110) of claim 1, wherein the outlet opening (32) is arranged on a hole circle (36) having a hole circle radius (38) measured from the longitudinal axis, the throw-off radius (72) of the outlet device (10; 110) being measured from the longitudinal axis and being larger than the hole circle radius (38).

8. The outlet device (10; 110) of claim 1, wherein the outlet device (10; 110) has a throw-off angle $\alpha>0°$ in relation to a tangent (78) that is tangent to the throw-off radius (72) of the outlet device (10; 110) measured from the longitudinal axis, the throw-off angle $\alpha$ having a value between 1° and 30°.

9. An outlet device (10; 110) of a solid bowl centrifuge (16) for separating a multi-phase material (18), the outlet device (10; 110) being arranged on an end wall (12) of a centrifuge bowl (14) that rotates in a rotational direction about a longitudinal axis (20), outlet openings (32) being formed in the end wall (12) concentrically around the longitudinal axis (20), the outlet device (10, 110) comprising:

a deflecting apparatus (40) aligned with each of the outlet openings (32) and configured so that a fluid (30) of the material (18) that has passed through the outlet opening (32) is deflected by the deflecting apparatus (40) in a direction (42) of a circumference (44) of the end wall (12), the deflecting apparatus (40) having a segment element (54) that is spaced from the longitudinal axis (20) by a segment radius (52), the segment element (54) including a deflecting segment (56) along which the deflected fluid (30) can be conducted toward the circumference (44) of the end wall (12) before being laterally thrown off by the outlet device (10; 110), and the outlet device (10; 110) further having a guide (64) arranged downstream of the segment element (54) with respect to the rotational direction, the guide (64) being at a position so that the fluid (30) reaches the guide (64) before the fluid (30) is thrown off by the outlet device (10; 110) and being configured to bring the deflected fluid (30) to a lower-energy positional potential in a gravitational field of the solid bowl centrifuge (16) before being thrown off by the outlet device (10; 110), the guide (64) further being configured so that the fluid (30) conducted along the deflecting segment (56) can be guided from the segment radius (52) to a throw-off radius (72) that is measured from the longitudinal axis and that is radially farther out from the longitudinal axis than the segment radius (52), wherein:

the outlet openings (32) are arranged on a hole circle (36) having a hole circle radius (38) measured from the longitudinal axis, the throw-off radius (72) of the outlet device (10; 110) being larger than the hole circle radius (38); and the outlet device (10; 110) comprises a dam element (58) that is spaced from the longitudinal axis (20) by a dam radius (62) that is measured from the longitudinal axis, wherein the throw-off radius (72) of the outlet device (10; 110) being larger than the dam radius (62).

10. The outlet device (10; 110) of claim 9, wherein the guide (64) comprises an acceleration segment (76), along which the fluid (30) can be accelerated between the segment radius (52) and the throw-off radius (72) of the outlet device (10; 110), the guide (64) being disposed and configured so that the fluid (30) reaches the acceleration segment (76) before the fluid (30) is thrown off by the outlet device (10; 110).

11. The outlet device (10; 110) of claim 10, wherein the guide (64) has a throw-off edge (74) that is arranged on the end wall (12) in such a way that the throw-off edge (74) is spaced from the longitudinal axis (20) by a throw-off radius (72) that is measured from the longitudinal axis, the throw-off radius (72) being larger than the segment radius (52).

12. The outlet device (10; 110) of claim 9, wherein the guide (64) comprises a curved guiding element (66) that extends from radially farther inside to radially farther outside.

13. The outlet device (10; 110) of claim 9, wherein the guide (64) comprises a concave guiding surface (70) that faces the longitudinal axis (20).

14. The outlet device (10; 110) of claim 9, wherein the outlet device (10; 110) has a throw-off angle $\alpha > 0°$ in relation to a tangent (78) that is tangent to the throw-off radius (72) of the outlet device (10; 110), the throw-off angle $\alpha$ having a value between 1° and 30°.

* * * * *